United States Patent [19]

Schröck

[11] Patent Number: 4,774,828

[45] Date of Patent: Oct. 4, 1988

[54] RADIAL PRESS

[76] Inventor: Peter Schröck, Krögerstr. 5, D-6000 Frankfurt/Main-1, Fed. Rep. of Germany

[21] Appl. No.: 70,165

[22] Filed: Jul. 1, 1987

Related U.S. Application Data

[63] Continuation of Ser. No. 841,935, Mar. 20, 1986.

[30] Foreign Application Priority Data

Apr. 3, 1985 [DE] Fed. Rep. of Germany ..... 3512241

[51] Int. Cl.[4] ..... B21D 41/04

[52] U.S. Cl. ..... 72/402; 72/453.01; 29/237

[58] Field of Search ..... 72/402, 452, 456, 453.01, 72/453.02, 453.09, 453.12, 453.04; 100/269 R; 29/237, 283.5

[56] References Cited

U.S. PATENT DOCUMENTS

| | | | |
|---|---|---|---|
| 2,197,441 | 4/1940 | Perony | 100/269 R |
| 2,296,072 | 9/1942 | Tucker | 100/269 R |
| 3,019,520 | 2/1962 | Woolley | 29/252 |
| 3,093,182 | 6/1963 | Vanderhoof | 72/402 |
| 3,343,252 | 9/1967 | Reesor | 29/520 |
| 3,461,710 | 8/1969 | Luedi | 72/402 |
| 3,461,712 | 8/1969 | Henkel et al. | 72/402 |
| 3,805,580 | 4/1974 | Leiker | 72/402 |
| 4,014,202 | 3/1977 | Van Allen et al. | 72/453.01 |
| 4,550,587 | 11/1985 | Eisenzimmer | 72/402 |

FOREIGN PATENT DOCUMENTS

| | | | |
|---|---|---|---|
| 2341093 | 9/1977 | France | 72/402 |
| 2602781 | 7/1976 | Fed. Rep. of Germany | 72/402 |

*Primary Examiner*—Daniel C. Crane
*Attorney, Agent, or Firm*—Felfe & Lynch

[57] ABSTRACT

A radial press having a plurality of dies concentrically arranged about an axis of the press is described. In particular, the dies are movable in a radial direction relative to the press axis by means of a cam member axially displaced relative to a pressure pad by an hydraulic drive mechanism. The drive mechanism having a piston, piston rod and bearings is attached to a pressure pad and to the cam member in a manner providing a large clearance space accommodating a variety of workpieces in the rear portion of the press. During the pressing operation, the piston rods are stressed in tension eliminating the need for an end plate and tension rods of prior art radial presses.

17 Claims, 4 Drawing Sheets

RADIAL PRESS

This application is a continuation, of application Ser. No. 841,935, filed Mar. 20, 1986.

The invention relates to a radial press, for workpieces having an axially symmetric outer surface, which comprises:

(a) A plurality of dies which are arranged in a circle about the axis of the outer surface of the workpiece, are movable radially toward that axis, and whose outer surface comprises at least one camming surface that is inclined relative to the axis;

(b) a cam member whose inner surface comprises at least one camming surface which cooperates with the camming surfaces of the dies; and (c) a drive means effecting the axial displacement of the cam member relative to a pressure pad and consisting of at least two hydraulically parallel-connected hydraulic cylinders with pistons and piston rods which are equidistantly distributed over the periphery of the cam member and are disposed parallel to the axis (A—A) of the workpiece.

By "axially symmetric outer surfaces" are meant workpiece shapes having circular cross sections and cross sections in the form of regular polygons, as encountered in hexagonal sections, for example. The outer surfaces of the workpieces may be straight, convex or stepped in the axial direction. The dies can be appropriately shaped for the handling of such workpiece surfaces. A specific application area for which the invention is particularly well suited is the fastening to hoses of hose fittings made of steel and the production of so-called thimbles.

From U.S. Pat. No. 3,805,580, a radial press of the type described at the outset is known wherein the drive means consists of two diametrically opposed hydraulic cylinders. The press has a frame formed by two end plates which are united by four rigid tension rods. Each hydraulic cylinder is located between two tension rods, and lateral openings are provided between two other pairs of tension rods to permit curved fittings to be pushed through. If the number of cylinders were to be doubled without the radial range of the press being enlarged, the two lateral openings would be blocked; and because of the lower end plate the back of the dies is not accessible from there, either. In addition to the tension rods, there are two piston rods, stressed in compression, which act upon a cam member for the dies through which the tension rods are run with radial play. Because of the multitude of parts, the press is heavy and has considerable axial length.

The object of the invention thus is to improve a radial press of the type described at the outset in such a way that, though of small size and low weight, it has directly to the rear of the cam member as large a clearance space as possible both for the insertion of fittings with pipe elbows and for the handling of fittings with elongated, long pipes and continuous tubing.

In accordance with the invention, this object is accomplished in the radial press described at the outside in that (d) the piston rods are secured at one of their ends in the pressure pad for the dies;

(e) the piston rods are run through the cam member, which is provided with bearings at the points where it is penetrated by the piston rods, radially outside of its camming surface;

(f) the piston rods are attached at their other, free ends to the pistons; and (g) the hydraulic cylinders surrounding the pistons are supported on the cam member so that during the pressing operation the piston rods are stressed in tension.

Through the measures in accordance with the invention, the separate press frame with the tension rods is dispensed with, as is one of the end plates which unites the tension rods and carries the hydraulic cylinders. The piston rods assume in addition the function of the tension rods, that is, they are stressed in tension instead of in compression, as well as the function of guide elements for the cam member. The other end plate then serves as pressure pad for the dies. The pressure pad may be in the form of a plate with mere radial guideways for the dies and serve solely as an axial abutment for the dies; however, it may also have mirror symmetry with respect to the cam member so far as the one or more camming surfaces are concerned, that is, generate also force components directed radially inward relative to the dies.

What is to be brought about is essentially only an axial relative motion between pressure pad and cam member, and the piston rods, stressed in tension, are mounted overhung on the other side of the cam member, with the result that the back or rear of the press is completely open and makes possible the handling of continuous tubing and of tubing with very long fittings.

The press has fewer parts, a lower weight for equal power and size, and a shorter axial overall length.

Moreover, the press can be enlarged modularly with additional hydraulic drives without sacrificing its advantages of unobstructed access from the rear. In principle, just one type, or just a few types, of appropriately dimensioned hydraulic drives will have to be stocked. The steps to be followed in assembling such a radial press will be described in detail in connection with the detailed description.

Above all, even with a multiple arrangement of individual hydraulic cylinders, for example, with four hydraulic cylinders, the clearance space in the rear of the press for the handling of workpieces of complex (curved) shape and of any desired length is larger. This is true with regard to curved workpieces especially when the spacing "s" between the outer surfaces of two hydraulic cylinders which are directly adjacent to each other in the peripheral direction is from 0.6 to 1.2 times the outside diameter of the hydraulic cylinders. The hydraulic cylinders are, of course, disposed sufficiently outward in the radial direction so that they do not project into the profile of the dies in their wide-open position.

In the radial press of the invention, the piston rods serve as extremely precise guide means for the cam member, and the hydraulic cylinders surrounding the pistons are supported on the cam member for free radial morion, so that redundancy of axial guide means between the cylindrical outer surface of the pistons and the sealing surface of the cylinders is avoided. In this way, long-lasting optimal sealing action is assured.

Here, too, it will be particularly advantageous if the cam member is a plate forming a regular polygon through whose center the common axis of workpiece and camming surface(s) extends, and if the piston rods of the hydraulic cylinders are run through the cam member in proximity to the corners of the polygon.

The weight of the cam member can be appropriately reduced in the manner indicated.

In connection with a further feature of the invention, it will be particularly advantageous if both the pressure pad and the cam member are in the form of a square plate with horizontally or vertically extending edges and two vertically extending faces, and if the axes of the piston rods which are diametrically opposed to each other in pairs both intersect a diagonal line $D_1$ or $D_2$, respectively, on the face of the cam member.

Regardless of whether the radial press is equipped with two double- or single-acting hydraulic cylinders whose diametrically opposed piston rods are located on a diagonal, or whether the radial press is equipped with four double- or single-acting hydraulic cylinders whose piston rods, diametrically opposed in pairs, are located on two diagonals which intersect each other at right angles, the press as a whole will be extremely compact with respect to its height and width.

An embodiment of the radial press in accordance with the invention will now be described in greater detail with reference to FIGS. 1 to 4, wherein.

Figure 1:
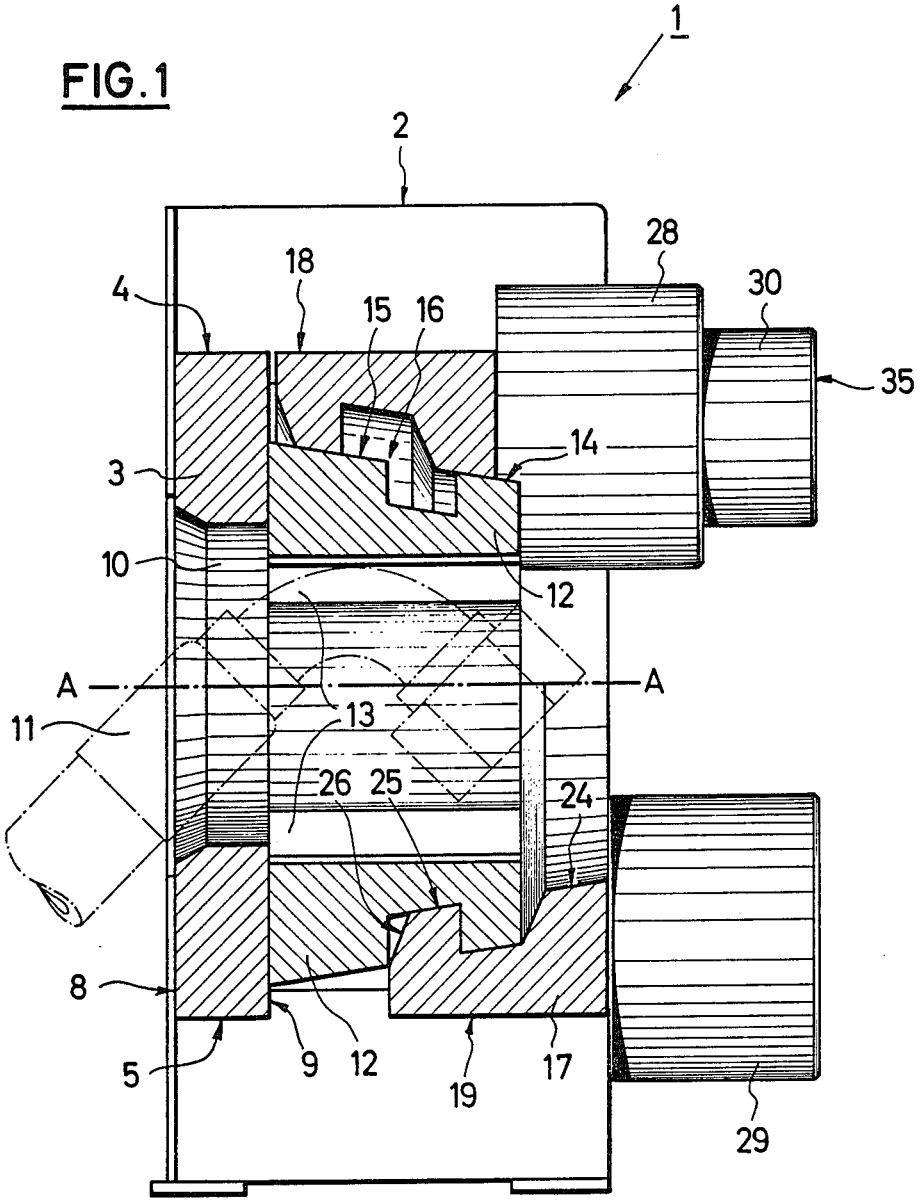
FIG. 1 is a vertical axial section through the radial press.
Figure 2:
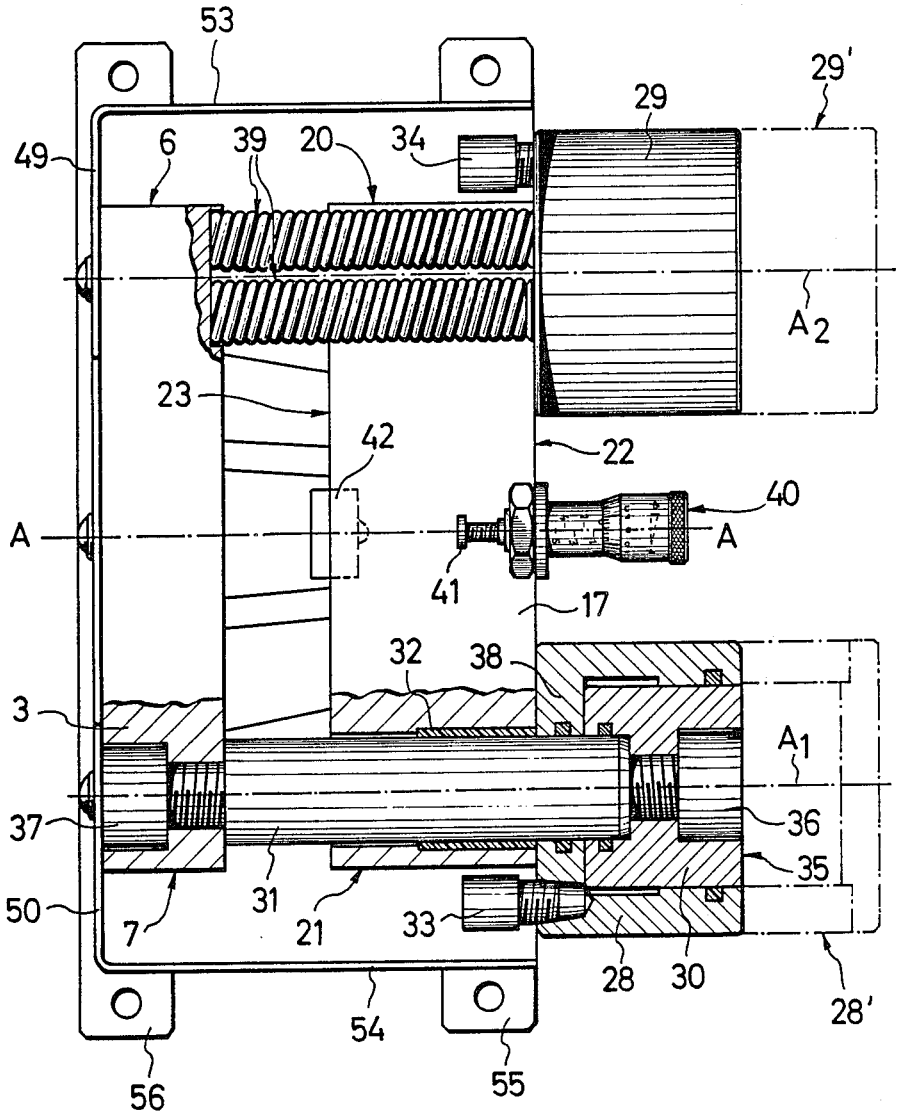
FIG. 2 is a horizontal section through the radial press of FIG. 1 along the axis of a hydraulic drive.

Shown in FIG. 1 is a vertical axial section through a complete radial press 1. Fastened to a casing 2 formed of angled sheet-meal parts is a pressure pad 3 consisting of a square plate with horizontally extending edges 4 and 5 and vertically extending edges 6 and 7 (FIG. 2). The pressure pad further has two vertically extending square faces 8 and 9 through whose plane diagonals an axis A—A, which may be termed the press or system axis, passes and with which the axis of the workpiece coincides during the pressing operation. The pressure pad 3 is further provided with an inlet opening 10 that is coaxial with the axis A—A and through which a workpiece 11 (a preassembled hose fitting), indicated by dash-dotted lines, can be introduced into the press. The side on which the pressure pad 3 is located is the so-called operator's side of the press.

Figure 3:
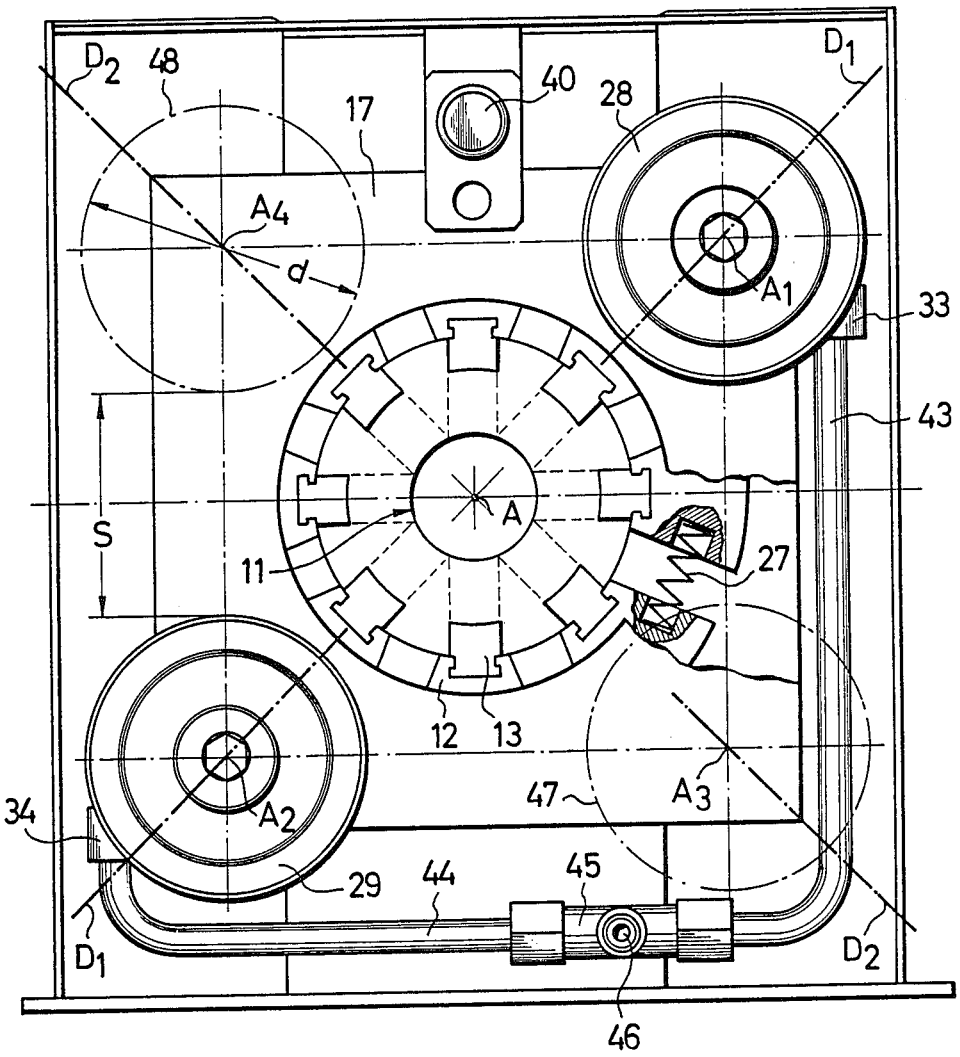
FIG. 3 is a rear elevation of the radial press of FIGS. 1 and 2.

Supported on the pressure pad 3 in the axial direction are eight dies 12 which are equidistantly distributed over the periphery of the inlet opening 10 and are movable in the radial direction. It is possible to guide the dies in the pressure pad 3 by means of radial dovetail guideways, which are part of the prior art and therefore are not shown, for the sake of simplicity. The dies are usually provided with so-called die heads 13 whose surfaces directed toward the axis A—A conform to the final workpiece geometry. (FIG. 3.)

The dies 12 have outer surfaces which comprise two moderately inclined surfaces 14 and 15 and a steeply inclined camming surface 16. Camming surface 16 is located between camming surfaces 14 and 15 and in the present case has been reduced with respect to its radial length to practically a camming edge.

The dies 12, arranged in a circle about the axis A—A, are surrounded by a cam member 17 which likewise consists of a square plate with horizontally extending edges 18 and 19, vertically extending edges 20 and 21, and likewise vertically extending faces 22 and 23. The contours of pressure pad 3 and cam member 17 are congruent in the projection along the axis A—A.

The cam member 17 has an inner surface composed solely of surfaces of revolution, the so-called camming surfaces, namely, two camming surfaces 24 and 25 with a moderate inclination that corresponds to the inclination of the camming surfaces 14 and 15 of the dies, and (on its face) a steeply inclined camming surface 26 that cooperates with the camming surfaces 16 of the dies.

The radial displacement of the dies 12 is effected through an axial displacement of the cam member 17. Shown below the axis A—A in FIG. 1 are the dies 12 in their wide-open position and the cam member 17 in its right end position. As soon as the cam member 17 is moved from the right to the left by means of the hydraulic drive illustrated in greater detail in FIGS. 2 and 3, the steeply inclined camming surfaces 16 and 26 come to slide on each other first, with the dies at first moving radially inward in the rapid idle stroke. Then the moderately inclined camming surfaces 14 and 24, and 15 and 25, respectively, come successively and simultaneously into engagement with each other so that the dies move radially inward in the slow power stroke until they reach the end position shown in FIG. 1 above the axis A—A, in which the cam member 17 is also in its left end position. In that position, the pressing operation is completed.

The opening of the dies is effected by reversing the direction of motion of the cam member 17, tangential compression springs 27 disposed between the individual dies urging the dies along the camming surfaces. (FIG. 3.)

According to FIG. 2, the hydraulic drive means consists of two hydraulically parallel-connected hydraulic cylinders 28 and 29, each having a piston 30 and a piston rod 31. The axes $A_1$ and $A_2$ of these hydraulic cylinders and piston rods are located radially outside of all camming surfaces of the cam member 17, are distributed equidistantly over its periphery, and extend parallel to the axis A—A. The connecting member for the transmission of the forces of reaction of the hydraulic cylinders 28 and 29 consists of the piston rods 31, which have the function of tension rods.

The piston rods 31 are fastened at one of their ends to the pressure pad 3 and penetrate the cam member 17, which is provided with sleeve bearings 32 at the points of penetration. At their other, free ends, the piston rods 31 are attached to the pistons 30, and the hydraulic cylinders 28 and 29 which surround the pistons are supported on the cam member 17 in the manner shown.

The hydraulic cylinders 28 and 29 are provided on their pressure sides with hydraulic-fluid connections 33 and 34, so that the hydraulic cylinders 28 and 29 can be displaced relative to the fixed pistons 30 in the direction of the axes $A_1$ and $A_2$, respectively, together with the cam member 17. FIG. 1 shows in its upper part that the pistons 30 are released during this displacement by the hydraulic cylinders, which move toward the left.

As is further apparent from FIG. 2, the pistons 30 are fastened from the direction of their end face 35 remote from the cam member 17, to the piston rods 31, each by means of a socket-head screw 36, inserted coaxially into the respective piston rod 31. Through appropriate radial and axial seating surfaces between piston 30 and piston rod 31, precise coaxial seating of the piston on the piston rod is obtained. At its other end, the piston rod 31 is similarly fastened to the pressure pad 3 by means of a further socket-head screw 37. The entire radial press can be readily assembled and disassembled in the manner shown. Before the pistons 30 are installed, the associated hydraulic cylinder is simply pushed onto the piston rod 31, with its end face 38, sealed relative to the piston rod 31, then being supported on the cam member 17 in the manner shown.

Disposed between the pressure pad 3 and the hydraulic cylinders 28 and 29 are compression springs 39, of which only a portion is shown, and which serve to return the cam member 17 into its outer end position. However, these compression springs may be dispensed with when the single-acting hydraulic cylinders 28 and 29 shown in FIG. 2 are replaced with double-acting hydraulic cylinders 28' and 29', as indicated by dash-dotted lines. In this case, the cylinders are fixed to the cam member. Attached to the cam member 17 is a micrometer 40 whose spindle 41 can be displaced by means of one revolution by a distance corresponding to a radial press displacement of one millimeter. The spindle 41 cooperates with a microswitch 42, thus limiting the axial displacement of the cam member 17 or the final diameter of the workpiece 11.

FIG. 3 further shows that the cam member 17 is in the form of a regular polygon, that is, is formed by a square plate through whose center the common axis A—A of the workpiece 11 and of the camming surfaces passes. As may further be seen, the axes $A_1$ and $A_2$ of the piston rods pass through the cam member 17 in proximity to the corners of the polygon or square. The two hydraulic cylinders 28 and 29 are diametrically opposed to each other on a diagonal line $D_1$ at the same distance from the axis A—A so that plane-parallel displacement of the cam member 17 is assured. The hydraulic cylinders 28 and 29 are hydraulically parallel-connected in that their hydraulic-fluid connections 33 and 34 are connected through lines 43 and 44 to a tee 45 which has a hydraulic-fluid connection 46 for connection to a hydraulic control unit that is not shown.

The cam member 17 further has a second diagonal line $D_2$. It may be equipped in proximity to its corners located on the diagonal line $D_2$ with two additional hydraulic cylinders 47 and 48, which are indicated only by dash-dotted lines and whose axes are designated $A_3$ and $A_4$. The radial press then has four hydraulic cylinders 28, 29, 47 and 48 which are diametrically opposed to one another in pairs with respect to the axis A—A. The spacing "s" between the outer surfaces of two hydraulic cylinders which are directly adjacent to each other in the peripheral direction is equal to about 0.8 times the outside diameter "d" of the hydraulic cylinder. Assurance is thus provided that a particularly bulky workpiece 11 provided with a pipe elbow (FIG. 1), for example, will fit between two hydraulic cylinders, in other words, that the hydraulic cylinders will not interfere with the accommodation of such a pipe elbow in the press.

Figure 4:
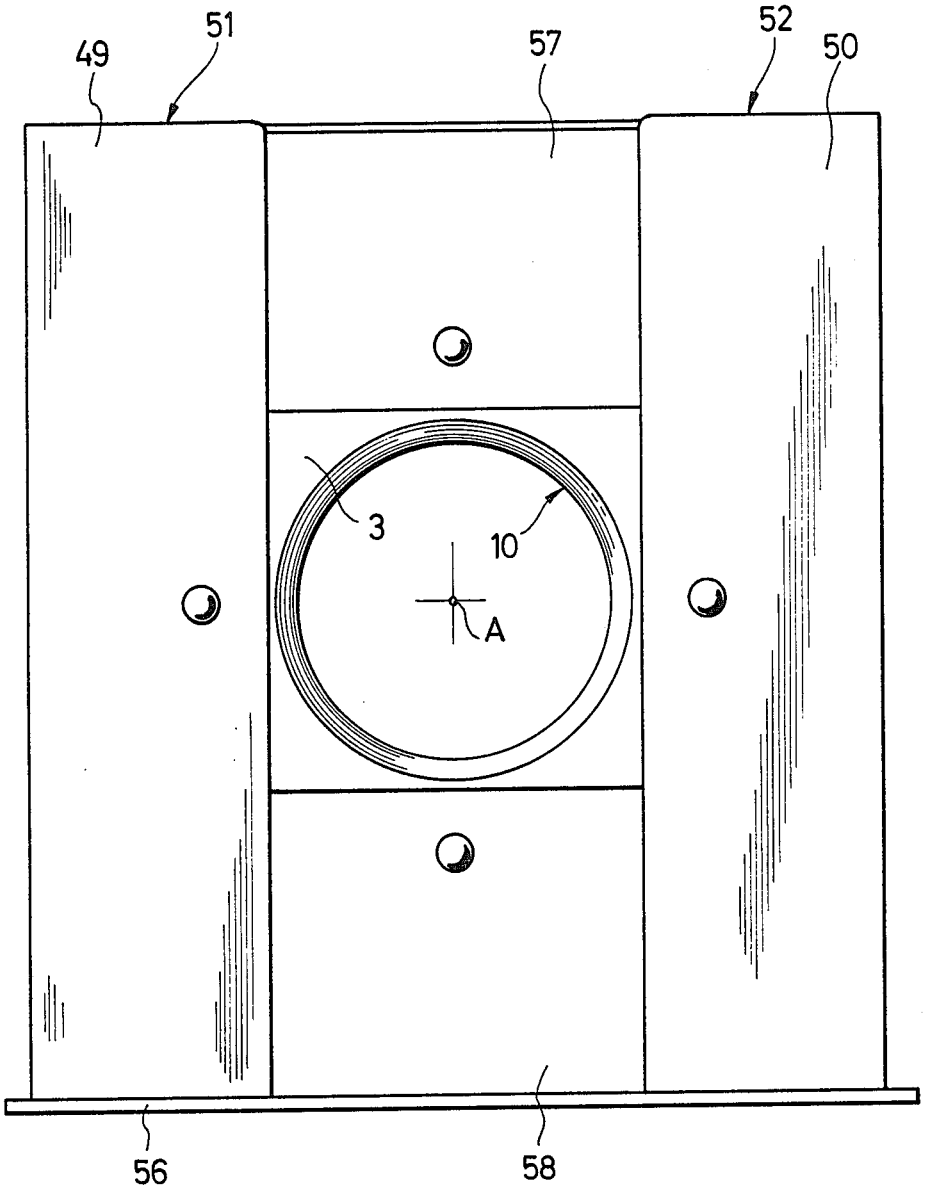
FIG. 4 is a front elevation of the completely encased radial press of FIG. 3.

It is apparent from the figures as a whole that the pressure pad 3 is secured to the coplanar flanges 49 and 50 of two L-shaped casing parts 51 and 52 which have mirror-image symmetry with respect to each other and whose parallel flanges 53 and 54 extend rearward all the way over the cam member 17. The bottom edges of the casing parts 51 and 52 are attached to continuous mounting flanges 55 and 56. As may be seen from FIG. 4, a further casing part 57 or 58, which is also secured to the pressure member 3, is disposed between the coplanar flanges 49 and 50 above or below, respectively, the inlet opening 10.

I claim:

1. A radial press having an axis extending through the radial press in a horizontal direction relative to an imaginary graph and accommodating a workpiece having both an axially symmetrical outer surface and an axis substantially corresponding to the axis of the radial press during the pressing operation, the radial press comprising:

(a) a casing having mounting means for orienting the axis of the press in the horizontal direction;

(b) a pressure pad immovably affixed to said casing and having a die mounting surface extending in a vertical direction relative to the axis of the radial press;

(c) a plurality of dies concentrically arranged about the axis of the radial press and supported by said die mounting surface of said pressure pad, said dies being movable in a substantially radial direction relative to the axis of the radial press, and each of said dies having an outer camming surface inclined in a direction relative to the axis of the radial press;

(d) a cam member having bearing means, a face and an inner camming surface cooperating with said outer camming surface of each of said dies; and (e) drive means having at least two hydraulically parallel-connected hydraulic cylinders for displacing said cam member in an axial direction substantially parallel to the axis of the radial press and relative to the pressure pad, each of said hydraulic cylinder having a piston and a piston rod, each of said hydraulic cylinders located in a position parallel to the axis of the radial press equidistantly spaced from the axis of the radial press in a periphery of said face of said cam member, said piston rod of each of said hydraulic cylinders having a first end secured in said pressure pad and a second end attached to said piston, said piston being immovably to said pressure pad, said piston rod extending through said cam member in a direction substantially parallel to the axis of the radial press and radially outward from said inner camming surface of said cam member, said bearing means in said cam member positioned near a portion of said piston rod which extends through said cam member for guiding said cam member on said piston rod, and each of said hydraulic cylinders surrounding each of said pistons is supported on said cam member so that said cam member moves with said cylinders upon application of hydraulic fluid to each of said cylinders and pistons whereby a back of the radial press is open to the surrounding environment and during the pressing operation said piston rod is stressed in tension.

2. A radial press according to claim 1, wherein said cam member comprises a plate in the form of a regular polygon having a center portion accommodating an axis of said cam member and the axis of the radial press, and corner portions positioned in proximity to an axis of said piston.

3. A radial press according to claim 1, wherein said piston has a first and second end, said first end adjacent to said face of said cam member and said second end remote from said face of said cam member and receiving a screw fastening said piston to said piston rod.

4. A radial press according to claim 3, wherein said hydraulic cylinder has a face portion and a bottom portion, said bottom portion supporting said hydraulic cylinder on said periphery of said face of said cam member and being sealed in said bottom portions adjacent to said cam member and said piston rod.

5. A radial press according to claim 2, wherein said pressure pad is plate-shaped having a substantially horizontally extending first edge, a substantially vertically extending second edge and a substantially vertically extending face relative to the axis of the radial press.

6. A radial press according to claim 2, wherein said cam member is plate-shaped having a substantially horizontally extending first edge, a substantially vertically extending second edge and a substantially vertically extending face relative to the axis of the radial press.

7. A radial press according to claim 2, wherein each of said piston rods having an axis parallel to the axis of the radial press is paired with another of said piston rod having an axis parallel to the axis of the radial press in a diametrically opposed arrangement in said cam member relative to said radial press axis, whereby said axes of said piston rods paired together intersect a diagonal line on said face of said cam member.

8. A radial press according to claim 1, wherein at least two of said hydraulic cylinders are diametrically opposed on said cam member relative to the axis of the radial press.

9. A radial press according to claim 1, wherein at least four of said hydraulic cylinders are arranged in diametrically opposed pairs on said cam member relative to the axis of the radial press.

10. A radial press according to claim 9, wherein at least two of said hydraulic cylinders are adjacently paired on said cam member in a spaced arrangement having a value in the range of 0.6 to 1.2 times of a diameter value of an outer surface of said hydraulic cylinder.

11. A radial press according to claim 1, wherein said casing comprises two L-shaped portions being mirror images of each other, said L-shaped portions being coplanar flanges attached to said pressure pad, flanges extending in a parallel direction relative to axis of the radial press accommodating substantially all of said cam member, and having a bottom portion near said pressure pad attached to said mounting means.

12. A radial press according to claim 11, wherein said casing further comprising a casing part disposed between said coplanar flanges secured to said pressure pad and accommodating an inlet opening for the workpiece.

13. A radial press according to claim 1, wherein said drive means comprises at least one compression spring disposed between said pressure pad and said cam member moving said drive means in an axial direction away from said pressure pad parallel to the axis of the radial press.

14. A radial press according to claim 1, wherein said drive means further comprises two double-acting hydraulic cylinders.

15. A radial press according to claim 1 wherein the pressure pad defines an inlet opening extending in the direction of the radial press axis and accommodating a workpiece, the pressure pas having a camming surface facing said cam member.

16. A radial press according to claim 1 wherein said pressure pad comprises a surface having a mirror symmetry to the inner camming surface of the cam member, said surface of said pressure pad facing said inner camming surface.

17. A radial press having an axis extending through the radial press in a horizontal direction relative to an imaginary graph accommodating a workpiece having both an axially symmetrical outer surface and having an axis substantially corresponding to the axis of the radial press during the pressing operation, the radial press comprising:

(a) a casing having mounting means for orienting the axis of the press in the horizontal direction;

(b) a plate-shaped pressure pad having a substantially horizontally extending first edge, a substantially vertically extending second edge and a substantially vertically extending die mounting face relative to the axis of the radial press, said pressure pad immovably affixed to said casing with said surface extending in a vertical direction relative to the axis of the radial press;

(c) a plurality of dies concentrically arranged about the axis of the radial press and supported by said face of said pressure pad, said dies being movable in a substantially radial direction relative to the axis of the radial press, and each of said dies having an outer camming surface inclined in a direction relative to the axis of the radial press;

(d) a plate-shaped cam member having a substantially horizontally extending first edge, a substantially vertically extending second edge, and a substantially vertically extending face relative to the axis of the radial press, and an inner camming surface cooperating with said outer camming surface of each of said dies and bearing means; and (e) drive means displacing said cam member in an axial direction substantially parallel to the axis of the radial press and relative to said pressure pad, said drive means having at least two hydraulically parallel-connected hydraulic cylinders disposed in positions parallel to the axis of the radial press equidistantly spaced from the axis of the radial press and supported along a periphery of said face of said cam member, said positions of said hydraulic cylinders diametrically opposed to each other, each of said hydraulic cylinders having a piston and a piston rod, each said piston rod surrounded by said hydraulic cylinder and having a first end secured in said pressure pad and a second end attached to said piston, said piston being immovably fixed relative to said pressure pad, and an axis parallel to the axis of the radial press intersecting a line extending on said face of said cam member diagonal to said cam member first and second edge, said piston rod extending through said cam member in a direction substantially parallel to the axis of the radial press and radially outward from said inner camming surface of said cam member, each said hydraulic cylinder is supported on said cam member so that said cam member moves with said cylinders upon application of hydraulic fluid to each of said cylinders and pistons, said bearing means in said cam member positioned near a portion of said piston rod which extends through said cam member for guiding said cam member on said piston rod, whereby a back of the radial press is open to the surrounding environment and said piston rod is stressed in tension during the pressing operation.

* * * * *

UNITED STATES PATENT AND TRADEMARK OFFICE

CERTIFICATE OF CORRECTION

PATENT NO. : 4,774,828

DATED : October 4, 1988

INVENTOR(S) : Peter Schröck

It is certified that error appears in the above-identified patent and that said Letters Patent is hereby corrected as shown below:

Col. 2, line 61 "morion" should read --motion--;

Col. 7, line 40 "being " should read --having--; and

Col. 7, line 63 "pas" should read --pad--.

Signed and Sealed this

Eighteenth Day of July, 1989

*Attest:*

DONALD J. QUIGG

*Attesting Officer*

*Commissioner of Patents and Trademarks*